US005882098A

United States Patent [19]

Brown et al.

[11] Patent Number: 5,882,098

[45] Date of Patent: Mar. 16, 1999

[54] PREASSEMBLED FOLDABLE PRINTER STAND

[75] Inventors: Charles R. Brown; Marion O. Fogle; Thomas F. Salley, all of Orangeburg, S.C.

[73] Assignee: Decolam, Inc., Orangeburg, S.C.

[21] Appl. No.: 885,296

[22] Filed: Jun. 27, 1997

[51] Int. Cl.[6] ..... A47B 43/00

[52] U.S. Cl. ..... 312/258; 312/262; 108/179; 16/389

[58] Field of Search ..... 312/258, 262, 312/223.6, 223.3; 211/149; 108/162, 115, 134, 179; 16/389

[56] References Cited

U.S. PATENT DOCUMENTS

| | | | |
|---|---|---|---|
| 915,618 | 3/1909 | Mattison | 312/262 X |
| 3,644,011 | 2/1972 | MacDonald | 312/258 |
| 3,865,051 | 2/1975 | Johl et al. | 16/389 X |
| 3,966,286 | 6/1976 | Groseclose | 312/258 |
| 4,099,809 | 7/1978 | Leotta | 312/258 X |
| 4,582,003 | 4/1986 | Valero | 108/179 |
| 5,518,310 | 5/1996 | Ellman et al. | 312/223.6 X |
| 5,664,854 | 9/1997 | Letch | 312/262 |

FOREIGN PATENT DOCUMENTS

| | | | |
|---|---|---|---|
| 136191 | 2/1950 | Australia | 312/258 |
| 1399532 | 7/1975 | United Kingdom | 16/389 |

*Primary Examiner*—Janet M. Wilkens
*Attorney, Agent, or Firm*—Cort Flint

[57] ABSTRACT

A preassembled, foldable utility stand for a computer printer and the like is disclosed having a folded and erect configuration wherein a vertical back panel pivotly carries a plurality of vertical shelf panels. The shelf panels fold upwardly to a generally vertically position disposed near the front surface of the back panel while a top shelf panel folds upwardly to overlay the rear surface of the back panel. A pair of side panels are pivotly carried by the back panel. Panel hinges with displaced pivots secure the top panel and the side panels to the back panel so that the top panel lies flush against the back panel and the side panels fold generally flat over the shelf panels when the stand is folded for a compact folded configuration.

20 Claims, 7 Drawing Sheets

Fig. 2
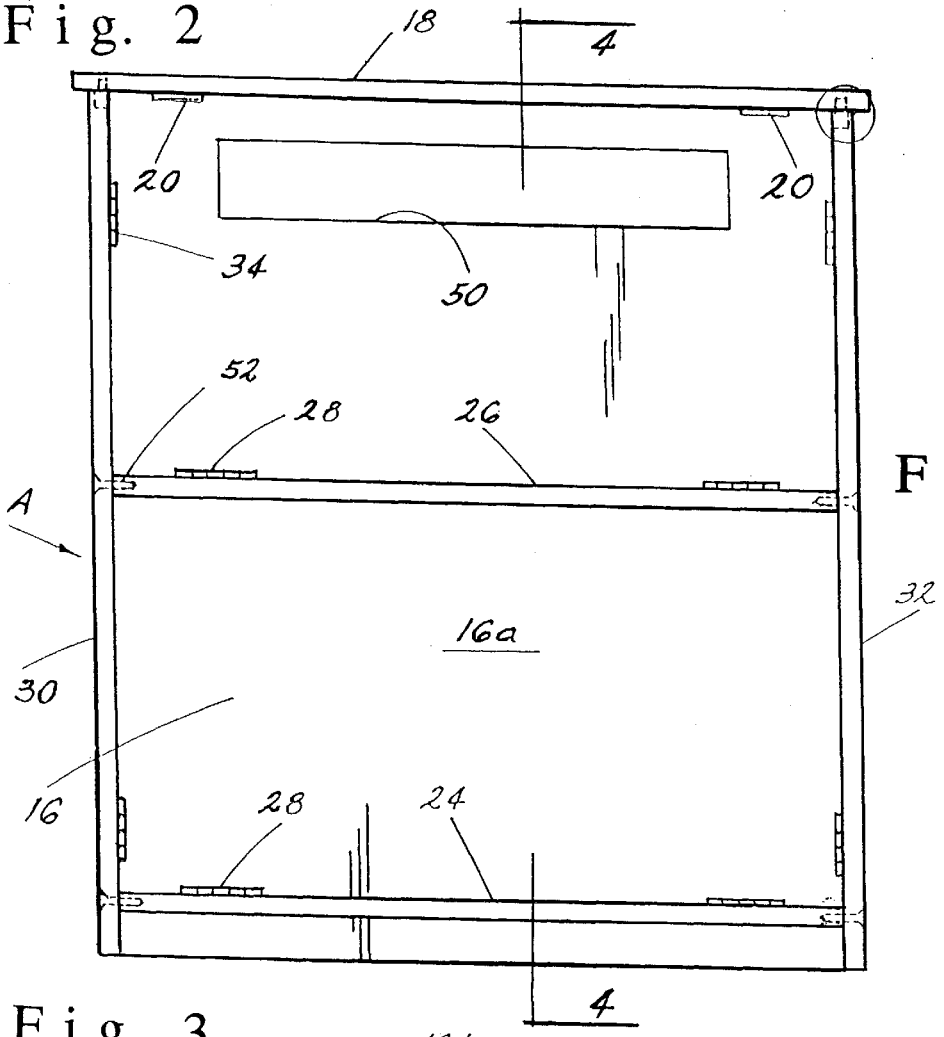
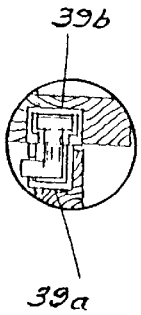
Fig. 2A
Fig. 3
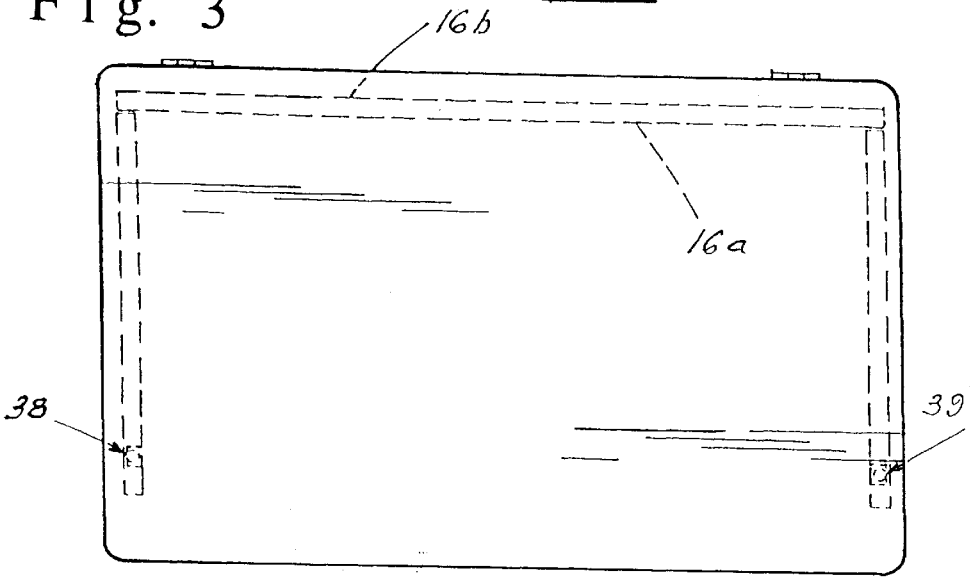

PREASSEMBLED FOLDABLE PRINTER STAND

BACKGROUND OF THE INVENTION

This invention relates to a preassembled foldable, ready to use utility stand, and more particularly, to a stand for computer equipment and the like such as a printer which may be folded for shipment or storage and which may be readily unfolded to a sturdy, erect configuration without need of assembly or other further effort.

Heretofore, desks and stands for computer equipment have been provided which are shipped unassembled and must be assembled by the purchaser. The assembly has required much time and effort, and often produces frustration since the parts and their assembly are numerous. Such desks and stands are not readily useable when purchased due to the time and effort required for assembly, nor may they be readily taken apart or folded for storage.

U.S. Pat. No. 4,099,809 discloses a collapsible work station which is connected to a partition extension wall. The work station comprises a rear support wall having a plurality of shelves of varying sizes. The shelves are hinged to the back support wall to assume various positions with respect to the support wall. Two side support walls fold over the shelves in a storing position. While this device provides a collapsible configuration for a work station there may be attached to partition walls and the like, the construction is not suitable for a general purpose utility stand wherein a closed top is desired. U.S. Pat. No. 4,579,401 discloses a collapsible cabinet, U.S. Pat. No. 2,764,462 discloses a portable collapsible bar, and U.S. Pat. No. 835,902 discloses a knockdown wardrobe being of only general interest to the present invention.

Accordingly, an object of the present invention is to provide a preassembled, foldable, ready to use utility stand for computer equipment and the like which may be readily folded for shipment or storage, and may be readily unfolded to a sturdy erect position for use.

Yet another important object of the present invention is to provide a utility stand having a folded configuration wherein various panels of the stand are folded about displaced pivots to provide a compact folded configuration.

SUMMARY OF THE INVENTION

The above objectives are accomplished according to the present invention by a preassembled, foldable ready to use utility stand having a folded and unfolded configuration comprising a back panel having a front and rear surface. A top panel is pivotly carried by the back panel by means of top panel hinges having a displaced pivot axis which allows folding flat against the rear surface of the back panel. The top panel has a generally vertical position disposed near the rear surface of the back panel when the stand is in a folded configuration, and a generally horizontal position near the top of the back panel when the stand is in an erect configuration. At least one lower shelf panel is pivotly carried by the back panel having a generally vertical position near the front surface of the back panel when the stand is folded, and a generally horizontal position when the stand is erect. A first side panel is carried by the back panel by means of first side panel hinges having a displaced pivot axis displaced a distance from the front surface of the back panel. In this manner, the first side panel may fold about the shelf panel when in the folded configuration. A second side panel is pivotly carried by the back panel by means of second side panel hinges having a displaced pivot axis so that the second side panel also folds inwardly about the shelf panels.

Preferably, an intermediate shelf panel is also carried by the back panel between the top panel and a bottom shelf panel. The intermediate shelf panel also has a vertical position near the front surface of the back panel when the stand is folded with the first and second side panels folded over the intermediate lower shelf panel.

Advantageously, the shelf panels include opposing side edges having predetermined edge cutouts which receive the side panel hinges when the shelf panels are in the vertical positions and the stand is folded. A first and second latch are carried between the first and second side panels and the top panel for latching the first and second side panels and top panel together when erected. The first and second side panels extend in a generally perpendicularly way from the front surface of the back panel. The first and second latches include latch finger elements carried by an upper edge of the first and second side panels, and cooperating latch elements carried by the top panel for latching with the first latch elements.

Advantageously, a compact configuration is provided by the top panel having a width generally equal to or greater than the width of the back panel, and the shelf panels having a width which is less than the width of the back panel. The side panels are spaced a distance less than or equal to the width of the back panel when the stand is erect. The thickness of the side panels plus the width of the shelf panels is less than or equal to the width of the back panel.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is a front view of the utility stand constructed according to the present invention having a folded and unfolded erect configuration;

FIG. 3 is a top plan view of the utility stand of the present invention;

DESCRIPTION OF A PREFERRED EMBODIMENT

Referring now in more detail to the drawings, a preassembled, foldable utility stand for a printer and the like, designated generally as A, is illustrated. For example, the preassembled, foldable utility stand may be utilized to support a printer 10 connected to associated computer equipment 12 carried on a computer desk 14. In this example, computer desk 14 may be a preassembled, foldable computer desk such as disclosed in applicant's copending patent application Ser. No. 08/754,887 filed on Nov. 11, 1996. The preassembled, foldable desk and stand, may be used together, and folded for storage and unfolded for use together. In the folded configurations, the stand and desk are compact and easily returned to an erect configuration for use.

Figure 1:
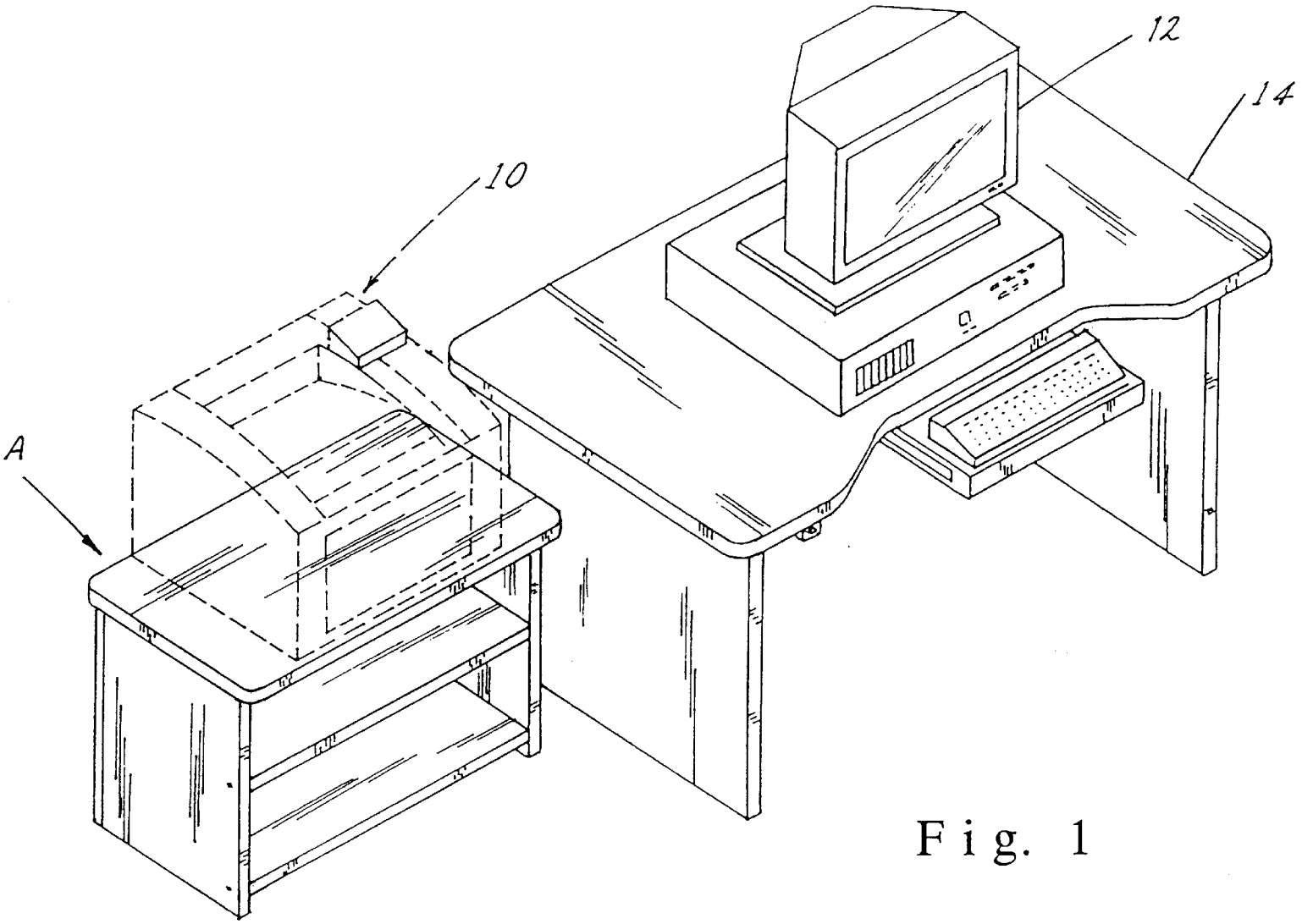
FIG. 1 is a prospective view illustrating a preassembled, portable printer stand for use with associated computer equipment disposed on an associated computer table.
Figure 4:
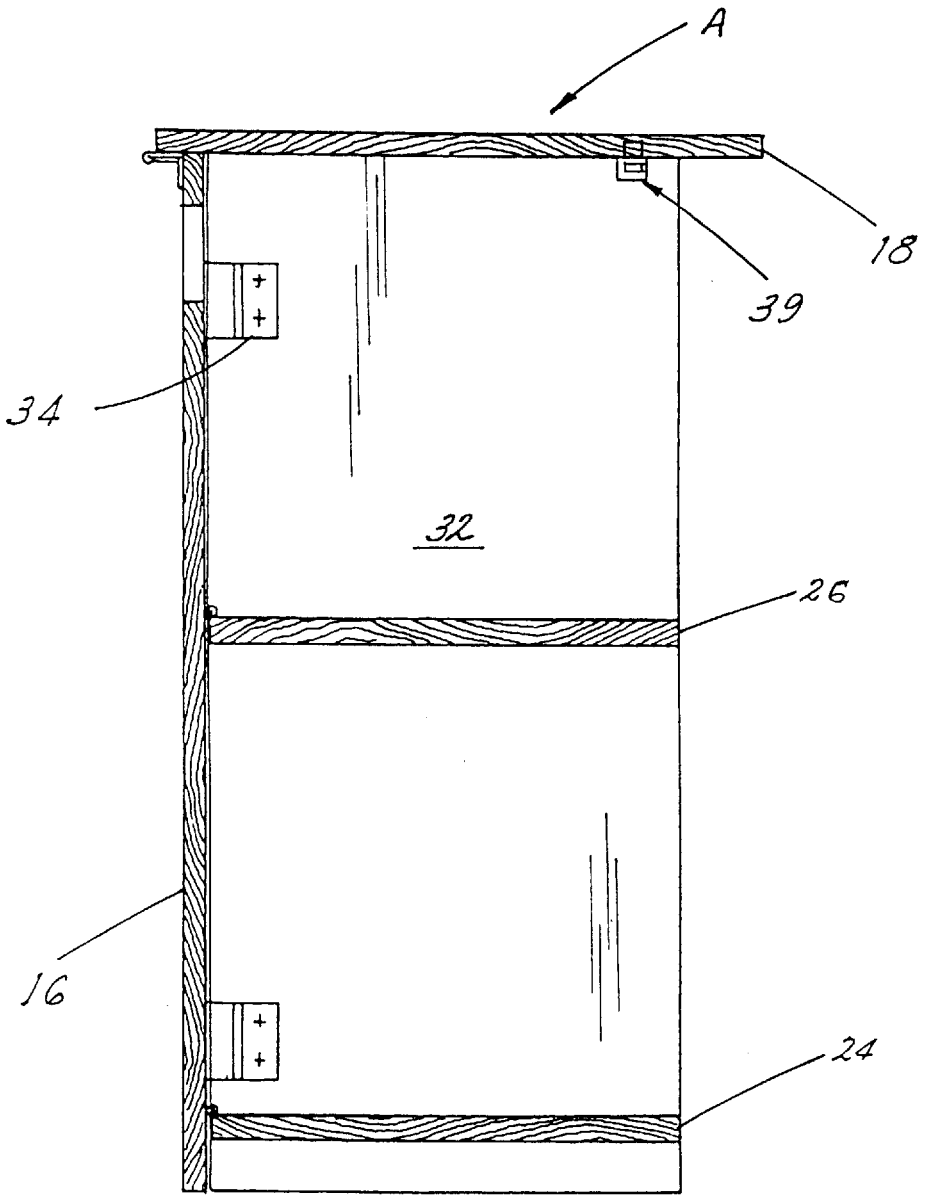
FIG. 4 is a sectional view taken along line 4—4 of FIG. 2.
Figure 5:
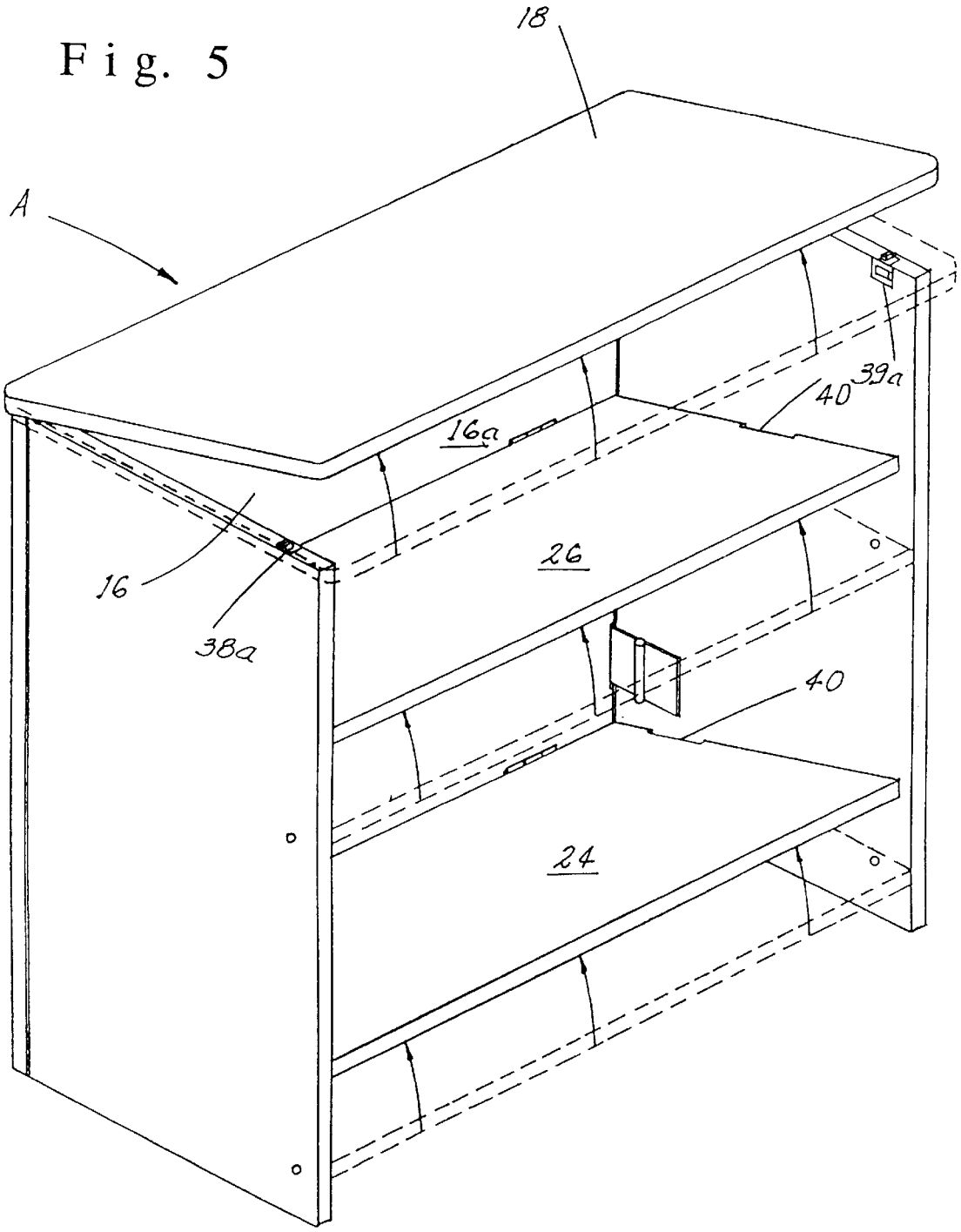
FIG. 5 is a prospective view of a preassembled, foldable utility stand with parts as shown for movement to a folded configuration.
Figure 10:
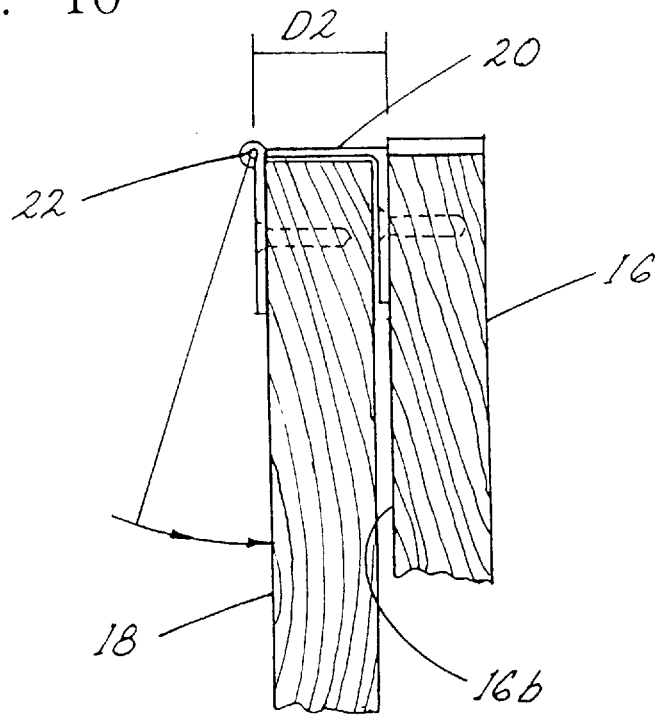
FIG. 10 is a side view of a top panel folded against a rear surface of a back panel of a preassembled, foldable utility stand constructed according to the present invention.

As can best be seen in FIGS. 2 and 5, preassembled, foldable utility stand A includes a back panel 16 having a front surface 16*a* and a back surface 16*b*. A top panel 18 is pivotly carried by back panel 16 by at least one top panel hinge 20 having a displaced pivot 22 which is displaced a distance D2 from the rear surface of back panel 16 (FIG. 10). Preferably there are two such hinges 20 carried in a spaced apart manner by back panel 16. There is at least one lower shelf panel 24, and preferably an intermediate shelf panel 26 pivotly carried by back wall 16. Shelf panels 24 and 26 are carried by conventional panel hinges 28.

Figure 9:
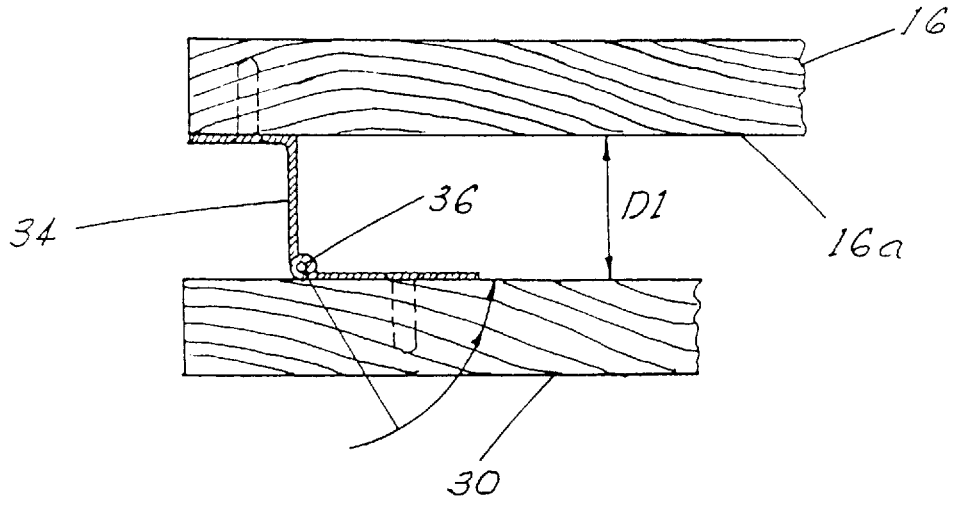
FIG. 9 is a top plan view illustrating a side panel folded relative to a back panel of a preassembled, foldable utility stand constructed according to the present invention.

A first side panel 30 and a second side panel 32 are pivotly carried by back panel 16. There is at least a first side panel hinge 34 having a displaced pivot axis 36 (FIG. 9) carried by the back panel which pivotly attaches each side panel to the back. Preferably, there are two such side panel hinges 34 which are spaced apart on each side of the back panel to secure the side panels. Each hinge has a displaced pivot axis 36 which is displaced a distance D1 from front surface 16*a* of the back panel so that the side panels may fold about the shelf panels when the stand is in a folded configuration.

Figure 7:
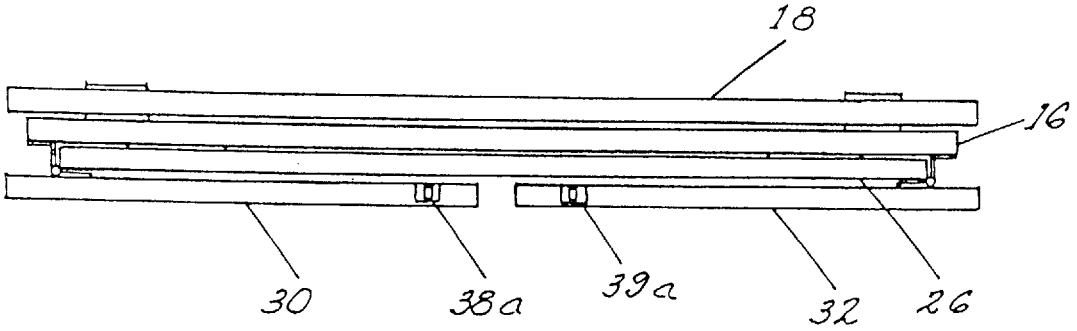
FIG. 7 is a top plan view of the utility stand of the present invention in a folded configuration.
Figure 8:
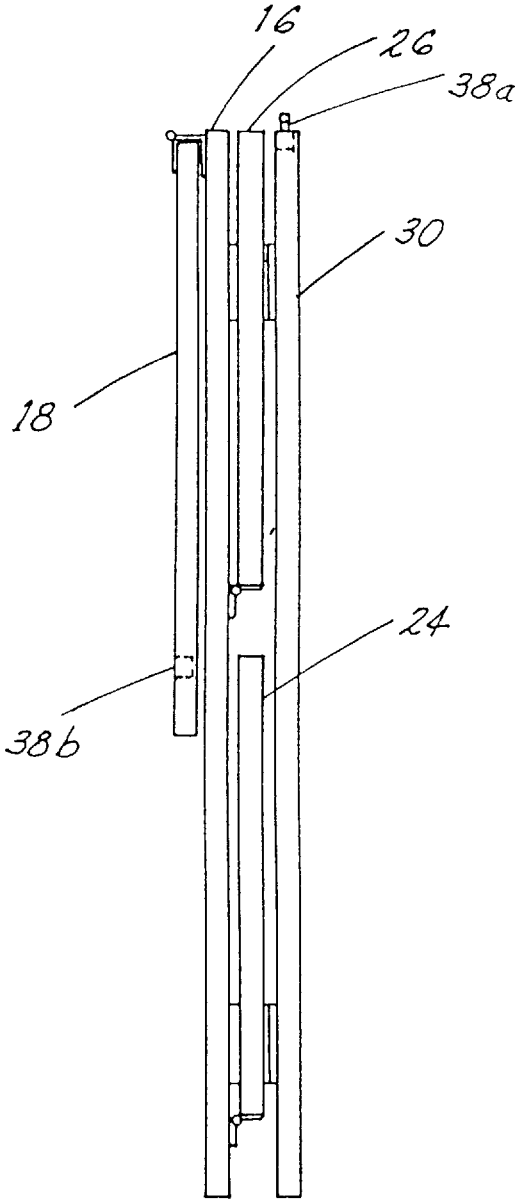
FIG. 8 is a side view of the utility stand of the present invention in a folded configuration.

As noted above, utility stand A has a folded configuration and an unfolded, erect configuration. The folded configuration is for storage and the unfolded configuration is for use. Top panel 18 has a generally vertical position disposed near rear surface 16*b* of back panel 16 when the stand is in the folded configuration, and top panel 18 has a generally horizontal position overlying the top edges of side panels 30, 32 and back panel 16 in the unfolded, erect configuration. Lower shelf panels 24, 26 have a generally vertical position near the front surface of back panel 16 when the stand is in the folded configuration, and a generally horizontal, cantilevered position when the stand is unfolded and erect. Side panels 30, 32 are folded about the folded shelf panels when the stand is in the folded configuration. As can best be seen in top plan view FIG. 7 and side elevation view FIG. 8, a compact configuration is provided for the utility stand by the construction of the present invention for storage, transportation, and shipping.

A first latch 38 is carried between first side panel 30 and top panel 18 for latching the side panel and top panel together in the unfolded configuration wherein the side panel extends generally perpendicularly away from the back panel. A second latch 39 is carried between the second side panel 32 and top panel 18 for latching the second side panel and top panel together in the unfolded configuration. First and second latch may be any suitable latch such as a cam lock latch having a first latch element 38*a* in the form of a projection carried by an upper edge of the first side panel and a corresponding first latch element 39*a* carried by an upper edge of second side panel 32. The projecting first latch elements are received in a cooperating receptacle latch element 38*b*, 39*b* carried recessed underneath top panel 18 (FIG. 2). The latches secure the stand in a sturdy erect configuration. A suitable latch is manufactured by METAL CANZI of BRISCO, ITALY under the name "Flick Lock."

Figure 6:
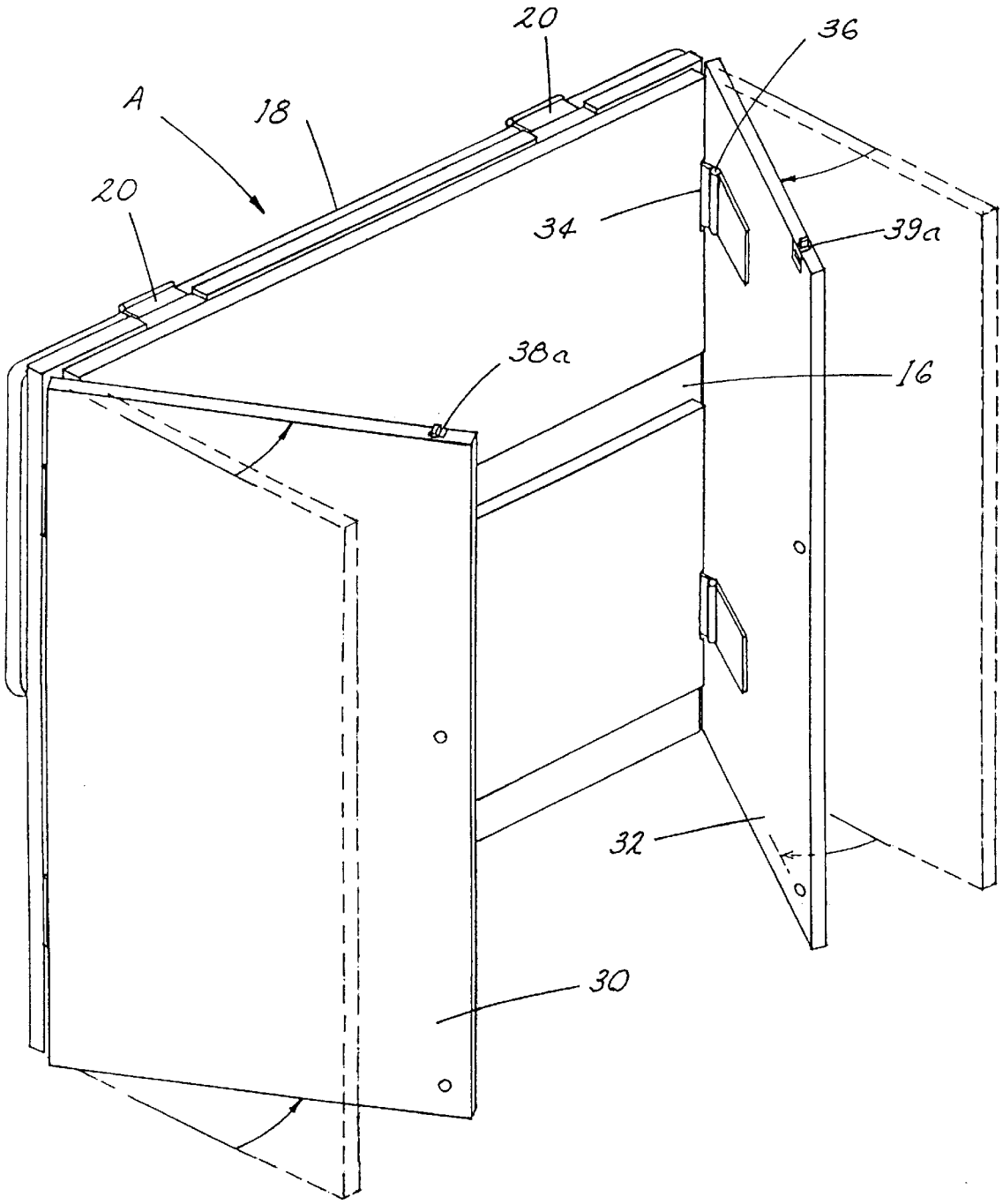
FIG. 6 is a prospective view of a preassembled, foldable utility stand according to the invention with top panels and shelf panels in folded positions and side panels being moved to a folded configuration of the stand.

As can best be seen in FIGS. 5 and 6, in order to facilitate folding to a compact configuration, edge cut-outs 40 are provided in opposing edges of shelf panels 24, 26 in order to receive and facilitate folding over side panel hinges 34. Top panel 18 has a width generally equal to or greater than the width of back panel 16 and shelf panels 24 and 26 have a width which is less than the width of the back panel as can best be seen in FIGS. 2 and 3. The outside exterior of side panels are spaced a distance apart less than or equal to the width of back panel 16 when the stand is erect in its unfolded configuration. The thickness of side panels 30 and 32, plus the width of shelf panels 24 and 26 is equal to the width of the back panel 16. A slot 50 may be provided for the routing of associated objects such as cables, paper, and the like when the utility stand is utilized for supporting a printer hooked to an associated computer.

To support shelf panels 24 and 26 in the unfolded configuration, shelf supports 52 are carried by side panels 30 and 32, which may be conventional screws or shelf supports.

While a preferred embodiment of the invention has been described using specific terms, such description is for illustrative purposes only, and it is to be understood that changes and variations may be made without departing from the spirit or scope of the following claims.

What is claimed is:

1. A preassembled, foldable ready to use utility stand having a folded and unfolded configuration comprising:

a back panel having a front surface and a rear surface;

a top panel pivotly carried by said back panel;

at least one top panel hinge having a displaced pivot axis displaced a distance from said rear surface of said back panel;

said top panel having a generally vertical position disposed near said rear surface of said back panel when said stand is in said folded configuration, and said top panel having a generally horizontal position near a top of said back panel when said stand is in said unfolded configuration;

at least one lower shelf panel pivotly carried by said back panel, and said shelf panel having a generally vertical position near the front surface of said back panel when said stand is in said folded configuration and a generally horizontal position when said stand is in said unfolded configuration;

a first side panel carried by said back panel;

at least a first side panel hinge pivotly connecting said first side panel to said back panel, said side panel hinge having a displaced pivot axis displaced a distance from the front surface of said back panel so that said first side panel folds inwardly about said shelf panel when said stand is being moved to said folded configuration;

a second side panel pivotly carried by said back panel;

at least a second side panel hinge pivotly connecting said second side panel to said back panel;

said second side panel hinge having a displaced pivot axis displaced a distance from the front surface of said back panel so that said second side panel folds inwardly about said shelf panel when said stand is being moved to said folded configuration; and said lower shelf panel includes opposing side edges having predetermined edge cutouts which receive respective ones of said side panel hinges when said shelf panel is in said vertical position and said stand is in said folded configuration.

2. The stand of claim 1 wherein said first and second side panels are folded inwardly in a generally common plane when said stand is in said folded configuration.

3. The stand of claim 1 including:

an intermediate shelf panel carried by said back panel between said top panel and said lower shelf panel; and said intermediate shelf panel having a vertical position near the front surface of said back panel when said stand is in said folded configuration with said first and second side panels folded over said intermediate shelf panel.

4. The stand of claim 1 including a pair of spaced top panel hinges having said displaced pivots for pivotly attaching said top panel to said back panel.

5. The stand of claim 1 including a pair of vertically spaced first side panel hinges having said displaced pivots for pivotly attaching first side panel to said back panel.

6. The stand of claim 5 including a pair of vertically spaced second side panel hinges carried by said front surface of said back panel having said displaced pivots for pivotly attaching said second side panel to said back panel and including a pair of said lower shelf panels wherein each panel includes opposing side edges having said predetermined edge cutouts which receive respective ones of said side panel hinges when said shelf panels are in said vertical positions and said stand is in said folded configuration.

7. The stand of claim 1 including a first latch carried between said first side panel and said top panel for latching said first side and top panels together when said stand is in said unfolded configuration wherein said first side panel extends in a generally perpendicularly way from the front surface of said back panel; and a second latch for latching said top panel and said second side panel together when said stand is in said unfolded configuration, said second side panel extending in a generally perpendicular manner from the front surface of said back panel.

8. The stand of claim 7 wherein said first and second latches include first latch elements carried by an upper edge of said first and second side panels, and second cooperating latch elements carried by said top panel for latching with said first latch elements.

9. The stand of claim 1 wherein said top panel has a width generally equal to or greater than the width of said back panel; and said shelf panels have a width which is less that the width of said back panel.

10. The stand of claim 9 wherein said side panels are spaced a distance less than or equal to the width of said back panel when said stand is in said unfolded configuration.

11. The stand of claim 10 wherein the thickness of said side panels plus the width of said shelf panels is less than or equal to the width of said back panel.

12. The stand of claim 1 wherein said back panel includes a slot opening for the routing of objects used with said stand.

13. A preassembled, foldable ready to use utility stand having a folded and unfolded, erect configuration comprising:

a planar vertical back panel having a planar front surface and a rear surface;

a plurality of vertically spaced shelf panels pivotly carried by said planar back panel;

a plurality of panel hinges securing said shelf panels to said planar front surface of said back panel in a manner that said shelf panels fold upwards to a generally vertical position disposed near the front surface of said back panel when said stand is folded;

one of said shelf panels constituting a bottom shelf panel for said stand when erect;

a first side panel carried by said back panel;

at least a first side panel hinge pivotly connecting said first side panel to said back panel, said side panel hinge having a first hinge leg affixed to said front surface of said planar back panel and a second leg affixed to said side panel, and said side panel hinge having a displaced pivot axis disposed between said first and second hinge legs and displaced a distance from the front surface of said back panel so that said first side panel folds flatly about said shelf panels;

a second side panel pivotly carried by said back panel;

at least a second side panel hinge pivotly connecting said second side panel to said planar front surface of said back panel, said second side panel hinge having a first hinge leg affixed to said front surface of said planar back panel and a second leg affixed to said second side panel; and said second side panel hinge having a displaced pivot axis disposed between said first and second hinge legs of said second panel hinge and displaced a horizontal distance from the front surface of said back panel so that said second side panel folds flatly about said shelf panels when folded.

14. The stand of claim 13, wherein said first and second side panels are folded inwardly in a generally common plane when said stand is in said folded configuration.

15. The stand of claim 14, wherein one of said shelf panels is a top panel disposed on a top of said stand which pivots upwardly and rearwardly to fold next to the rear surface of said back panel.

16. The stand of claim 15 including a pair of spaced top panel hinges having said displaced pivots for pivotly attaching said top panel to said back panel.

17. The stand of claim 16 including a pair of vertically spaced first side panel hinges having said displaced pivots for pivotly attaching said first side panel to said back panel; and a pair of vertically spaced second side panel hinges having said displaced pivots for pivotly attaching said second side panel to said back panel.

18. The stand of claim 17 wherein said shelf panels include opposing side edges having predetermined edge cutouts which receive respective ones of said side panel hinges when said shelf panels are in said vertical positions and said stand is in said folded configuration.

19. The stand of claim 15 including a first latch carried between said first side panel and said top panel for latching said first side and top panels together wherein said first side panel extends in a generally perpendicularly way from the front surface of said back panel when the stand is erect; and a second latch for latching said top panel and said second side panel together when said stand is in said unfolded configuration, said second side panel extending in a generally perpendicular manner from the front surface of said back panel when the stand is erect so that a sturdy erect configuration is provided.

20. The stand of claim 13, wherein said side panels are spaced a distance less than or equal to the width of said back panel when said stand is in said unfolded configuration, and the thickness of said side panels plus the width of said shelf panels is less than or equal to the width of said back panel.

* * * * *

UNITED STATES PATENT AND TRADEMARK OFFICE

CERTIFICATE OF CORRECTION

PATENT NO. : 5,882,098
DATED : March 16, 1999
INVENTOR(S) : Charles R. Brown, et. al.

It is certified that error appears in the above-identified patent and that said Letters Patent is hereby corrected as shown below:

Column 1, after the title, insert the following:

-- This application is a continuation-in-part of co-pending application serial number 754,887 filed November 22, 1996, now US Patent Number 5,769,514 issued on June 23, 1998, entitled Ready To Use Foldable Computer Desk.--

Signed and Sealed this

Twenty-fourth Day of August, 1999

*Attest:*

Q. TODD DICKINSON

*Attesting Officer*

*Acting Commissioner of Patents and Trademarks*